US009268276B2

(12) United States Patent
Hirose et al.

(10) Patent No.: US 9,268,276 B2
(45) Date of Patent: Feb. 23, 2016

(54) FIXING DEVICE AND IMAGE FORMING APPARATUS THAT INCLUDE A SEPARATOR DISPOSED DOWNSTREAM FROM A FIXING NIP

(71) Applicants: Fumihiro Hirose, Kanagawa (JP); Masami Okamoto, Kanagawa (JP); Keisuke Kubota, Kanagawa (JP); Kenji Nozawa, Kanagawa (JP); Yuuki Kikushima, Kanagawa (JP); Yoshikuni Sasaki, Kanagawa (JP); Kensuke Yamaji, Kanagawa (JP); Shuutaroh Yuasa, Kanagawa (JP); Kaori Hemmi, Kanagawa (JP)

(72) Inventors: Fumihiro Hirose, Kanagawa (JP); Masami Okamoto, Kanagawa (JP); Keisuke Kubota, Kanagawa (JP); Kenji Nozawa, Kanagawa (JP); Yuuki Kikushima, Kanagawa (JP); Yoshikuni Sasaki, Kanagawa (JP); Kensuke Yamaji, Kanagawa (JP); Shuutaroh Yuasa, Kanagawa (JP); Kaori Hemmi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/640,768

(22) Filed: Mar. 6, 2015

(65) Prior Publication Data

US 2015/0253708 A1 Sep. 10, 2015

(30) Foreign Application Priority Data

Mar. 7, 2014 (JP) ..... 2014-044882
May 13, 2014 (JP) ..... 2014-099470

(51) Int. Cl.
*G03G 15/20* (2006.01)

(52) U.S. Cl.
CPC ..... *G03G 15/2085* (2013.01); *G03G 15/2028* (2013.01); *G03G 2215/2032* (2013.01)

(58) Field of Classification Search
CPC ..... G03G 15/2085
USPC ..... 399/329
See application file for complete search history.

(56) References Cited

U.S. PATENT DOCUMENTS

2008/0080909 A1* 4/2008 Yamada
2009/0003897 A1 1/2009 Yamada (Continued)

FOREIGN PATENT DOCUMENTS

JP 57-054261 3/1982
JP 2002-091222 3/2002

(Continued)

OTHER PUBLICATIONS

Amano et al., JP2011-123286, "Fixing Device and Image Forming Apparatus", Jun. 23, 2011, JPO Machine English Translations of Detailed Description.*

*Primary Examiner* — Susan Lee
(74) *Attorney, Agent, or Firm* — Oblon, McClelland, Maier & Neustadt, L.L.P.

(57) ABSTRACT

A fixing device includes a fixing belt stretched taut across a fixing rotator and a support rotator. A pressure rotator is pressed against the fixing rotator via the fixing belt to form a fixing nip between the fixing belt and the pressure rotator, through which a recording medium bearing a toner image is conveyed. The pressure rotator includes a recess defining an outer diameter of each lateral end of the pressure rotator in an axial direction thereof that is greater than an outer diameter of a center of the pressure rotator in the axial direction thereof. A first separator is disposed downstream from the fixing nip in a recording medium conveyance direction and contacts an inner circumferential surface of the fixing belt. The first separator is isolated from the pressure rotator and includes a projection disposed opposite the recess of the pressure rotator.

18 Claims, 10 Drawing Sheets

(56) References Cited

U.S. PATENT DOCUMENTS

| | | | |
|---|---|---|---|
| 2009/0238615 | A1 | 9/2009 | Katabami et al. |
| 2011/0081173 | A1* | 4/2011 | Watanabe et al. |
| 2011/0164904 | A1* | 7/2011 | Hirose et al. |

FOREIGN PATENT DOCUMENTS

| | | | |
|---|---|---|---|
| JP | 2006-030869 | | 2/2006 |
| JP | 2006-171551 | | 6/2006 |
| JP | 2006-243471 | | 9/2006 |
| JP | 2007-047379 | | 2/2007 |
| JP | 2007-057682 | | 3/2007 |
| JP | 2007-065082 | | 3/2007 |
| JP | 2007-065092 | | 3/2007 |
| JP | 2007-086530 | | 4/2007 |
| JP | 2007-114634 | | 5/2007 |
| JP | 2007-121363 | | 5/2007 |
| JP | 2007-121451 | | 5/2007 |
| JP | 2007-164025 | | 6/2007 |
| JP | 2007-199383 | | 8/2007 |
| JP | 2008-134356 | | 6/2008 |
| JP | 2009-031759 | | 2/2009 |
| JP | 2009-116128 | | 5/2009 |
| JP | 2011-043608 | | 3/2011 |
| JP | 2011-123296 | | 6/2011 |
| JP | 2011123286 | A * | 6/2011 |
| JP | 2012-132994 | | 7/2012 |
| JP | 2013-057730 | | 3/2013 |
| JP | 2013-097098 | | 5/2013 |

* cited by examiner

FIXING DEVICE AND IMAGE FORMING APPARATUS THAT INCLUDE A SEPARATOR DISPOSED DOWNSTREAM FROM A FIXING NIP

CROSS-REFERENCE TO RELATED APPLICATIONS

This patent application is based on and claims priority pursuant to 35 U.S.C. §119 to Japanese Patent Application Nos. 2014-044882, filed on Mar. 7, 2014, and 2014-099470, filed on May 13, 2014, in the Japanese Patent Office, the entire disclosure of each of which is hereby incorporated by reference herein.

BACKGROUND

1. Technical Field

Exemplary aspects of the present disclosure relate to a fixing device and an image forming apparatus, and more particularly, to a fixing device for fixing a toner image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator, a support rotator disposed opposite the fixing rotator, and a fixing belt stretched taut across the fixing rotator and the support rotator. A pressure rotator is pressed against the fixing rotator via the fixing belt to form a fixing nip between the fixing belt and the pressure rotator, through which a recording medium bearing a toner image is conveyed. The pressure rotator includes a recess defining an outer diameter of each lateral end of the pressure rotator in an axial direction thereof that is greater than an outer diameter of a center of the pressure rotator in the axial direction thereof.

A first separator is disposed downstream from the fixing nip in a recording medium conveyance direction and contacts an inner circumferential surface of the fixing belt. The first separator is isolated from the pressure rotator and includes a projection disposed opposite the recess of the pressure rotator.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator, a support rotator disposed opposite the fixing rotator, and a fixing belt stretched taut across the fixing rotator and the support rotator. A pressure rotator is pressed against the fixing rotator via the fixing belt to form a fixing nip between the fixing belt and the pressure rotator, through which the recording medium bearing the toner image is conveyed. The pressure rotator includes a recess defining an outer diameter of each lateral end of the pressure rotator in an axial direction thereof that is greater than an outer diameter of a center of the pressure rotator in the axial direction thereof. A first separator is disposed downstream from the fixing nip in the recording medium conveyance direction and contacts an inner circumferential surface of the fixing belt. The first separator is isolated from the pressure rotator and includes a projection disposed opposite the recess of the pressure rotator.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
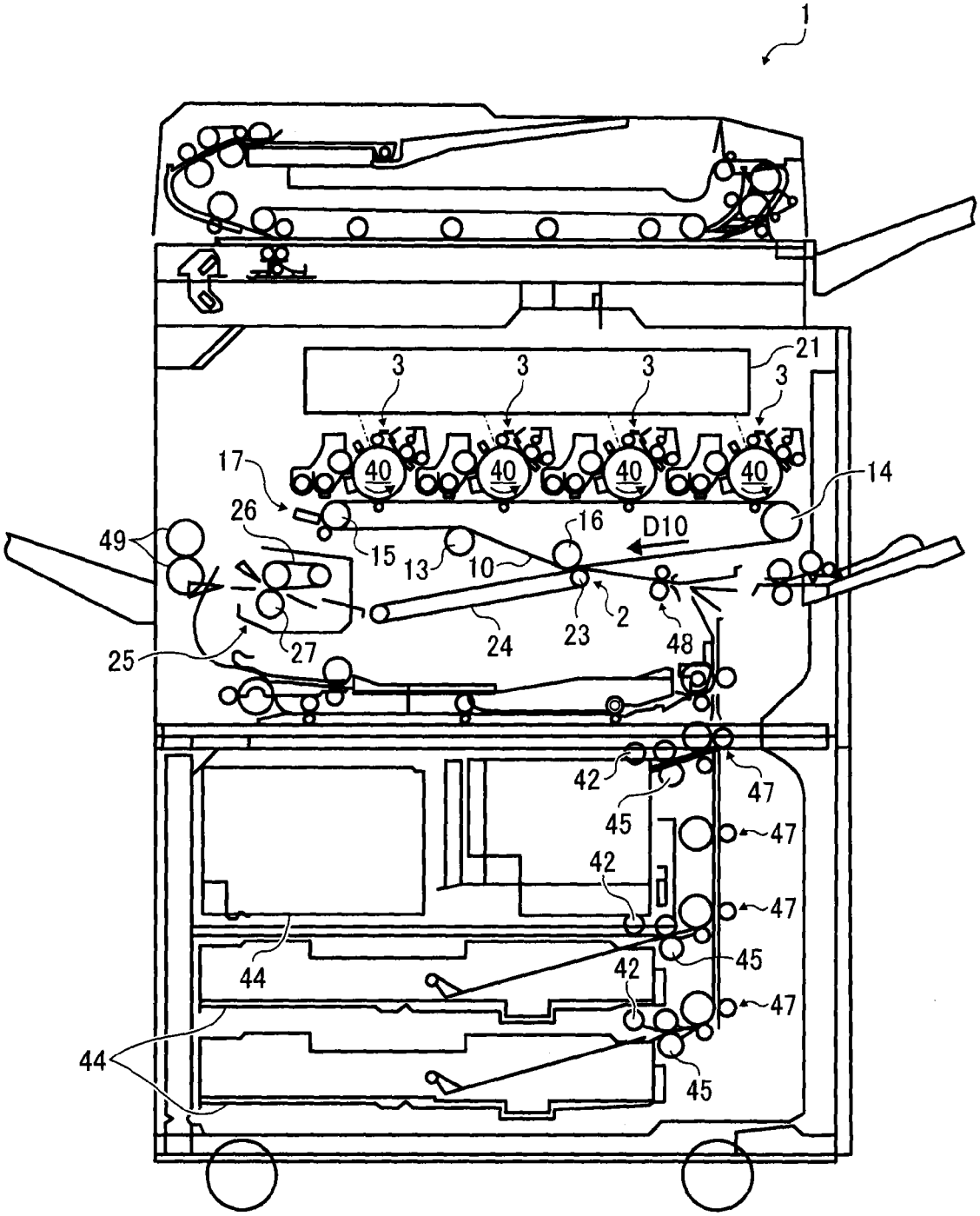
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color copier that forms color and monochrome toner images on recording media by electrophotography.

With reference to FIG. 1, a description is provided of a construction of the image forming apparatus 1.

As shown in FIG. 1, the image forming apparatus 1 is a tandem copier employing an indirect or intermediate transfer method. An intermediate transfer belt 10, that is, an endless belt, is situated in a center portion of a body of the image forming apparatus 1. The intermediate transfer belt 10 is looped over a plurality of support rollers 13, 14, 15, and 16 and rotatable clockwise in FIG. 1 in a rotation direction D10.

On the left of the support roller 15 is an intermediate transfer belt cleaner 17 that removes residual toner failed to be transferred onto a sheet serving as a recording medium and therefore remaining on the intermediate transfer belt 10 therefrom. The intermediate transfer belt cleaner 17 includes a cleaning blade made of urethane and in contact with the intermediate transfer belt 10 in a direction counter to the rotation direction D10 of the intermediate transfer belt 10. The intermediate transfer belt cleaner 17 further includes a conveyor that conveys toner collected by the cleaning blade to a rear portion of the image forming apparatus 1 where the toner falls down by gravity or the like into a waste toner container. The waste toner container includes a toner level detector that detects an amount of toner collected into the waste toner container. When the waste toner container is full, the image forming apparatus 1 stops based on a detection result from the toner level detector, preventing toner from being spilled out from the waste toner container.

Above an upper face of the intermediate transfer belt 10 are four image forming devices 3 aligned in the rotation direction D10 of the intermediate transfer belt 10 to form black, magenta, cyan, and yellow toner images, respectively, thus constituting a tandem structure of the image forming apparatus 1. Above the image forming devices 3 is an exposure device 21.

The support roller 16 situated at a lower center inside a loop formed by the intermediate transfer belt 10 is disposed opposite a secondary transfer roller 23. Downstream from a secondary transfer device 2 including the secondary transfer roller 23 in a sheet conveyance direction is a fixing device 25 that fixes a toner image transferred from the intermediate transfer belt 10 onto the sheet thereon. The fixing device 25 includes a fixing belt 26 and a pressure roller 27 serving as a pressure rotator or a pressure member pressed against the fixing belt 26.

As a user presses a start button on a control panel of the image forming apparatus 1, a driving motor drives and rotates one of the support rollers 14, 15, and 16. Accordingly, other support rollers including the support roller 13 are driven and rotated, thus rotating the intermediate transfer belt 10 in the rotation direction D10. Simultaneously, as photoconductors 40 incorporated in the image forming devices 3 rotate counterclockwise in FIG. 1, the exposure device 21 forms electrostatic latent images on the photoconductors 40 and the image forming devices 3 develop the electrostatic latent images into black, magenta, cyan, and yellow toner images, respectively. As the intermediate transfer belt 10 rotates in the rotation direction D10, the black, magenta, cyan, and yellow toner images formed on the photoconductors 40 are primarily transferred onto the intermediate transfer belt 10 successively such that the black, magenta, cyan, and yellow toner images are superimposed on a same position on the intermediate transfer belt 10, thus forming a color toner image thereon.

On the other hand, as the user presses the start button, one of feed rollers 42 incorporated in a sheet feeder is selectively rotated to pick up and feed a sheet from one of paper trays 44 layered in a paper bank. A separation roller 45 separates the sheet from other sheets in the paper tray 44 and feeds the sheet to a sheet conveyance path. A conveyance roller pair 47 conveys the sheet to a sheet conveyance path inside the body of the image forming apparatus 1 where the sheet strikes a registration roller pair 48 that halts the sheet. The registration roller pair 48 starts rotation to feed the sheet to a secondary transfer nip formed between the intermediate transfer belt 10 and the secondary transfer roller 23 at a time when the color toner image formed on the intermediate transfer belt 10 reaches the secondary transfer nip. As the sheet is conveyed through the secondary transfer nip, the secondary transfer roller 23 secondarily transfers the color toner image onto the sheet.

A belt 24 incorporated in the secondary transfer device 2 conveys the sheet bearing the color toner image to the fixing device 25 that fixes the color toner image on the sheet under heat and pressure. Thereafter, an output roller pair 49 ejects the sheet bearing the fixed color toner image onto an output tray that stacks the sheet. After the secondary transfer of the color toner image, the intermediate transfer belt cleaner 17 removes residual toner failed to be transferred onto the sheet and therefore remaining on the intermediate transfer belt 10 therefrom, causing the image forming apparatus 1 to be ready for a next image forming operation.

Figure 2:
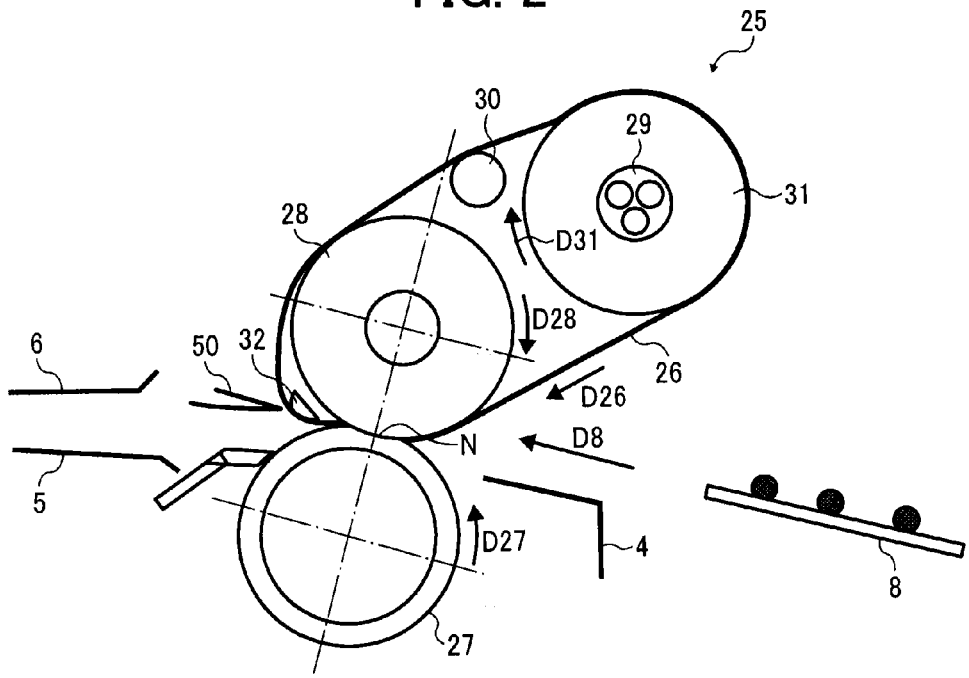
FIG. 2 is a schematic vertical sectional view of a fixing device installed in the image forming apparatus shown in FIG. 1.

With reference to FIG. 2, a description is provided of a construction of the fixing device 25 incorporated in the image forming apparatus 1 described above.

FIG. 2 is a schematic vertical sectional view of the fixing device 25. As shown in FIG. 2, the fixing device 25 (e.g., a fuser or a fusing unit) employs a belt fixing method. The fixing belt 26 is supported by and stretched taut across a fixing roller 28 serving as a fixing rotator or a fixing member and a heating roller 31 serving as a support rotator. The fixing roller 28 is a driving roller that drives and rotates the fixing belt 26. As a driver drives and rotates the fixing roller 28 in a rotation direction D28, the fixing roller 28 in turn rotates the fixing belt 26 in a rotation direction D26. The fixing belt 26 rotates the heating roller 31 in a rotation direction D31.

The pressure roller 27 is disposed opposite the fixing roller 28 via the fixing belt 26. A pressurization assembly presses the pressure roller 27 against the fixing roller 28 via the fixing belt 26 to form a fixing nip N between the pressure roller 27 and the fixing belt 26.

A fixing heater 29 serving as a heater is disposed inside the heating roller 31. The fixing heater 29 heats the heating roller 31 which in turn heats the fixing belt 26. A tension roller 30 disposed inside a loop formed by the fixing belt 26 increases an area where the fixing belt 26 contacts the heating roller 31, thus increasing an amount of heat conducted from the heating roller 31 to the fixing belt 26. As the fixing belt 26 rotates, the pressure roller 27 rotates in a rotation direction D27 in accordance with rotation of the fixing belt 26. Alternatively, a driver may drive and rotate the pressure roller 27 so that the pressure roller 27 drives and rotates the fixing belt 26.

A separation pad 32, serving as a first separator, a separation assist member, or a separation support member, is disposed downstream from the fixing nip N formed between the fixing belt 26 and the pressure roller 27 in a sheet conveyance direction D8 in which a sheet 8 bearing a toner image is conveyed through the fixing device 25. The separation pad 32 is disposed inside the loop formed by the fixing belt 26 and serves as a sheet separation aid that facilitates separation of the sheet 8 from the fixing belt 26.

A temperature detection element detects the temperature of an outer circumferential surface of the fixing belt 26. A controller (e.g., a processor), that is, a central processing unit (CPU) provided with a random-access memory (RAM) and a read-only memory (ROM), for example, operatively connected to the temperature detection element and the fixing heater 29 controls the fixing heater 29 based on a temperature of the fixing belt 26 detected by the temperature detection element to adjust the temperature of the outer circumferential surface of the fixing belt 26 to a predetermined temperature.

As the sheet 8 bearing the unfixed toner image, after entering the fixing device 25, is conveyed through the fixing nip N formed between the fixing belt 26 and the pressure roller 27, the toner image is melted and fixed on the sheet 8 at the fixing nip N adjusted at the predetermined temperature.

A separation device 50 serving as a second separator is disposed downstream from the fixing nip N in the sheet conveyance direction D8. The separation device 50 separates the sheet 8 bearing the fixed toner image and being adhered to the fixing belt 26 therefrom. Thereafter, the sheet 8 is ejected to an outside of the fixing device 25.

Upstream from the fixing nip N in the sheet conveyance direction D8 is an entry guide 4 that guides the sheet 8 to the fixing nip N. Downstream from the fixing nip N in the sheet conveyance direction D8 are exit guides 5 and 6 that guide the sheet 8 to the outside of the fixing device 25.

Figure 3:
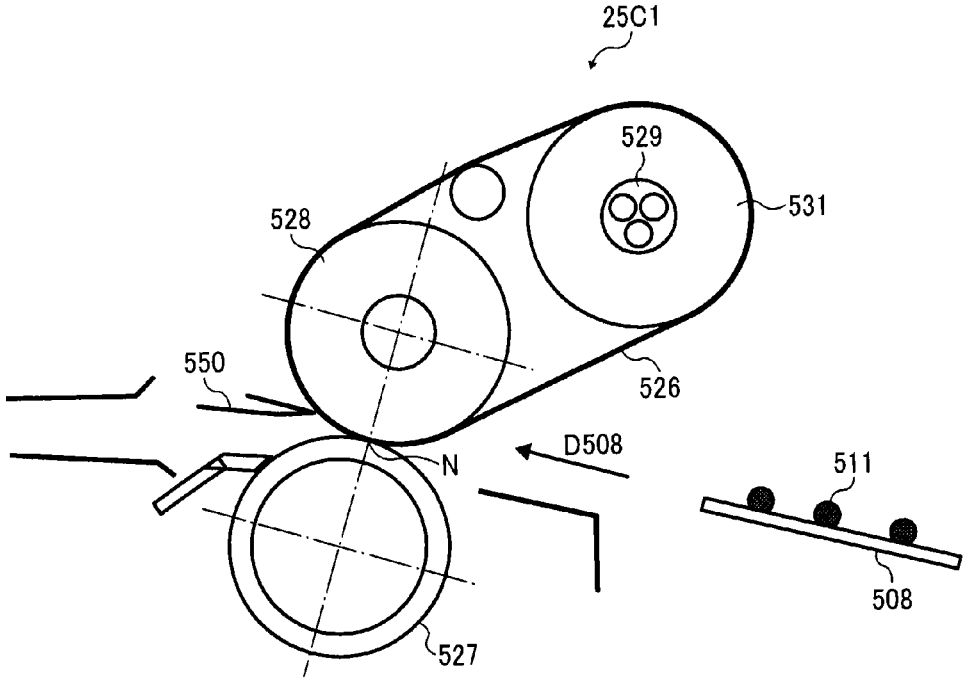
FIG. 3 is a schematic vertical sectional view of a comparative fixing device.

With reference to FIG. 3, a description is provided of a construction of a comparative fixing device 25C1.

FIG. 3 is a schematic vertical sectional view of the comparative fixing device 25C1. As shown in FIG. 3, the comparative fixing device 25C1 includes a heating roller 531 accommodating a halogen heater 529; an endless fixing belt 526 stretched taut across the heating roller 531 and a fixing roller 528; and a pressure roller 527 pressed against the fixing roller 528 via the fixing belt 526 to form a fixing nip N between the fixing belt 526 and the pressure roller 527. As a sheet 508 bearing a toner image 511 is conveyed through the fixing nip N, the fixing belt 526 heated by the halogen heater 529 through the heating roller 531 and the pressure roller 527 fix the toner image 511 on the sheet 508 under heat and pressure in the belt fixing method. Since the fixing belt 526 has a decreased thermal capacity, the fixing belt 526 is heated quickly, shortening a warm-up time to warm up the fixing belt 526 and saving energy.

The toner image 511 fused on the sheet 508 comes into contact with the fixing belt 526. To address this circumstance, the fixing belt 526 is coated with fluoroplastic that facilitates separation of the toner image 511 from the fixing belt 526. Additionally, the comparative fixing device 25C1 includes a separation claw 550 that separates the sheet 508 from the fixing belt 526.

If the comparative fixing device 25C1 is installed in a monochrome image forming apparatus, the fixing belt 526 is coated with Teflon®. Hence, even if the separation claw 550 contacts the fixing belt 526, the fixing belt 526 is immune from damage, achieving an extended operation life.

Conversely, if the comparative fixing device 25C1 is installed in a color image forming apparatus, in order to enhance color development, the fixing belt 526 includes a surface layer made of silicone rubber treated with fluorine coating (e.g., a tetrafluoroethylene-perfluoroalkyl vinyl ether copolymer (PFA) tube having a thickness of about several dozens of micron) or a surface layer produced by applying oil to a silicone rubber surface layer.

Accordingly, the surface layer of the fixing belt 526 installed in the color image forming apparatus is soft and susceptible to a claw mark and a scratch caused by the separation claw 550. When the surface layer of the fixing belt 526 is damaged, streaks may appear on the toner image 511 fixed on the sheet 508.

Alternatively, fluorine tape may be adhered to the separation claw 550 to enhance quality of the toner image 511 fixed on the sheet 508.

However, an experience is needed to adhere the tape to a front edge of the separation claw 550. Accordingly, an inexperienced engineer may not adhere the tape to a desired position on the separation claw 550. Consequently, the separation claw 550 adhered with the tape at an inappropriate position thereon may damage the surface layer of the fixing belt 526, resulting in damage to the toner image 511 on the sheet 508.

To address this circumstance, the color image forming apparatus may employ a non-contact separation method not using the separation claw 550 that contacts the fixing belt 526.

However, in the non-contact separation method, if toner of the toner image 511 is susceptible to adhesion to the fixing belt 526, the sheet 508 ejected from the fixing nip N may be wound around the fixing belt 526 readily. Accordingly, the sheet 508 is susceptible to jamming. For example, a color toner image formed of a plurality of toner layers different in color is more susceptible to adhesion to the fixing belt 526. Accordingly, the sheet 508 bearing the color toner image may be wound around the fixing belt 526 and jammed.

To address this circumstance, the color image forming apparatus may employ first to third separation methods for separating the sheet 508 from the fixing belt 526 as described below.

The first method is a non-contact separation plate method that uses a separation plate disposed opposite the fixing belt 526 with a slight interval in a range of from about 0.2 mm to about 1.0 mm therebetween and extended in a longitudinal direction of the fixing belt 526. The second method is a con-contact separation claw method that uses a plurality of separation claws disposed opposite the fixing belt 526 with a slight interval in a range of from about 0.2 mm to about 1.0 mm therebetween and aligned in the longitudinal direction of the fixing belt 526 with a predetermined interval between the adjacent separation claws. The third method is a self stripping method that uses the rigidity of the sheet 508 and the elasticity of a curve of each of the fixing belt 526 and the pressure roller 527 to peel the sheet 508 off the fixing belt 526 naturally.

However, in each of the first to third methods, an interval is provided between the fixing belt 526 and a sheet guide disposed downstream from an exit of the fixing nip N in a sheet conveyance direction D508. Accordingly, when the sheet 508 is thin paper, a sheet having a decreased top margin, or a sheet bearing a solid image such as a photographic image, the sheet 508 may pass through the interval between the fixing belt 526 and the sheet guide while it is adhered to the fixing belt 526. Consequently, the sheet 508 may be wound around the fixing belt 526 or strike the separation plate or the separation claw, resulting in jamming.

Figure 4:
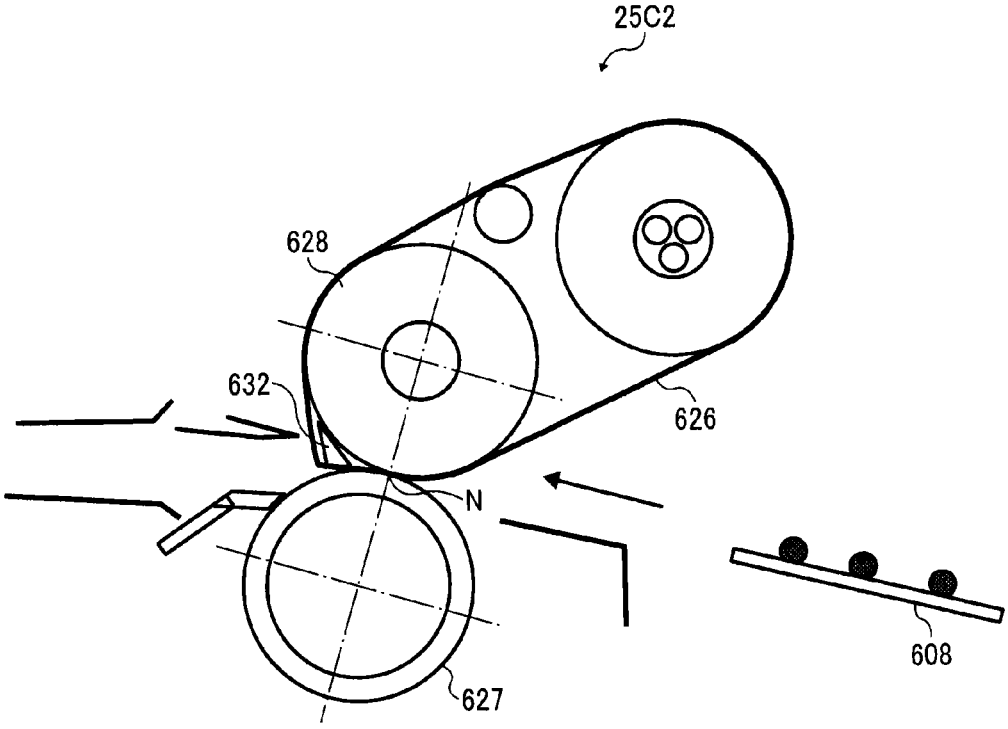
FIG. 4 is a schematic vertical sectional view of another comparative fixing device.

To address this circumstance, the color image forming apparatus may employ a separation pad method, as an enhancement of the self stripping method, that uses a separation pad serving as a non-contact separator provided inside a loop formed by a fixing belt 626 as shown in FIG. 4.

FIG. 4 is a schematic vertical sectional view of a comparative fixing device 25C2 employing the separation pad method. As shown in FIG. 4, the comparative fixing device 25C2 includes a separation pad 632 disposed downstream from and in proximity to a fixing nip N formed between the fixing belt 626 and a pressure roller 627 pressed against a fixing roller 628 via the fixing belt 626. The separation pad 632 presses the fixing belt 626 against the pressure roller 627 so that an outer circumferential surface of the fixing belt 626 contacts an outer circumferential surface of the pressure roller 627. The separation pad 632 separates a sheet 608 from the fixing belt 626 even if the sheet 608 has a decreased paper weight that may disturb separation of the sheet 608.

Figure 5:
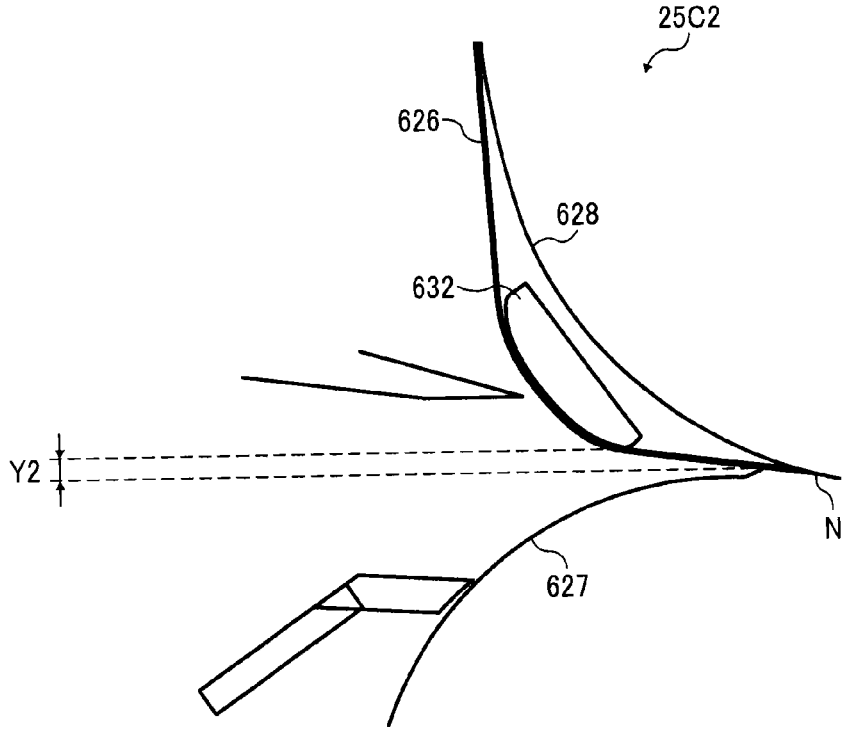
FIG. 5 is a partial vertical sectional view of the comparative fixing device shown in FIG. 4 illustrating a lateral end of a pressure roller in an axial direction thereof.
Figure 6:
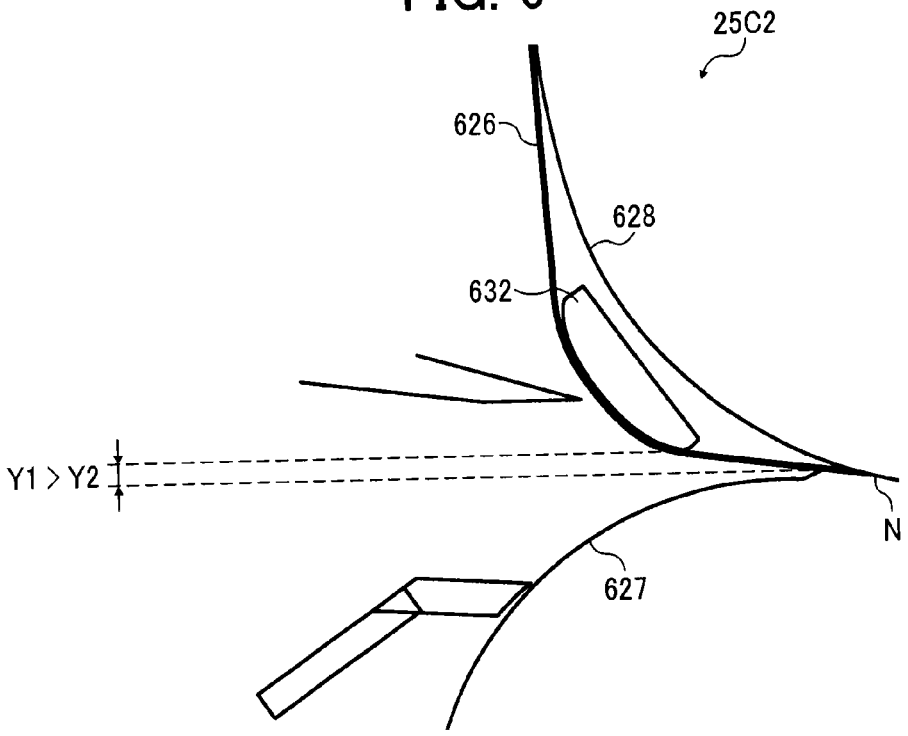
FIG. 6 is a partial vertical sectional view of the comparative fixing device shown in FIG. 4 illustrating a center of the pressure roller in the axial direction thereof.

However, the pressure roller 627 of the comparative fixing device 25C2 has the recessed outer circumferential surface to prevent creasing of the sheet 608. For example, an outer diameter of each lateral end of the pressure roller 627 in an axial direction thereof is greater than an outer diameter of a center of the pressure roller 627 in the axial direction thereof. FIG. 5 is a partial vertical sectional view of the comparative fixing device 25C2 illustrating the lateral end of the pressure roller 627 in the axial direction thereof. FIG. 6 is a partial vertical sectional view of the comparative fixing device 25C2 illustrating the center of the pressure roller 627 in the axial direction thereof. As shown in FIGS. 5 and 6, an interval Y2 between the separation pad 632 and each lateral end of the pressure roller 627 in the axial direction thereof at an exit of the fixing nip N shown in FIG. 5 is smaller than an interval Y1 between the separation pad 632 and the center of the pressure roller 627 in the axial direction thereof at the exit of the fixing nip N shown in FIG. 6. Accordingly, a curvature of the pressure roller 627 separates the sheet 608 from the fixing belt 626 insufficiently, degrading separation of the sheet 608 from the fixing belt 626.

A detailed description is now given of a configuration of the separation pad 32 and the pressure roller 27.

Figure 7:
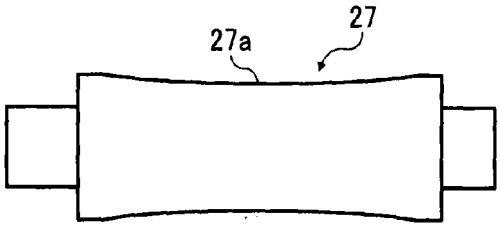
FIG. 7 is a plan view of a pressure roller incorporated in the fixing device shown in FIG. 2.

FIG. 7 is a plan view of the pressure roller 27. As shown in FIG. 7, an outer diameter of a center of the pressure roller 27 in an axial direction thereof is smaller than an outer diameter of each lateral end of the pressure roller 27 in the axial direction thereof. Thus, the pressure roller 27 includes a recess 27*a* that defines a hand drum shape or a substantially prismatic shape of the pressure roller 27.

Figure 8:
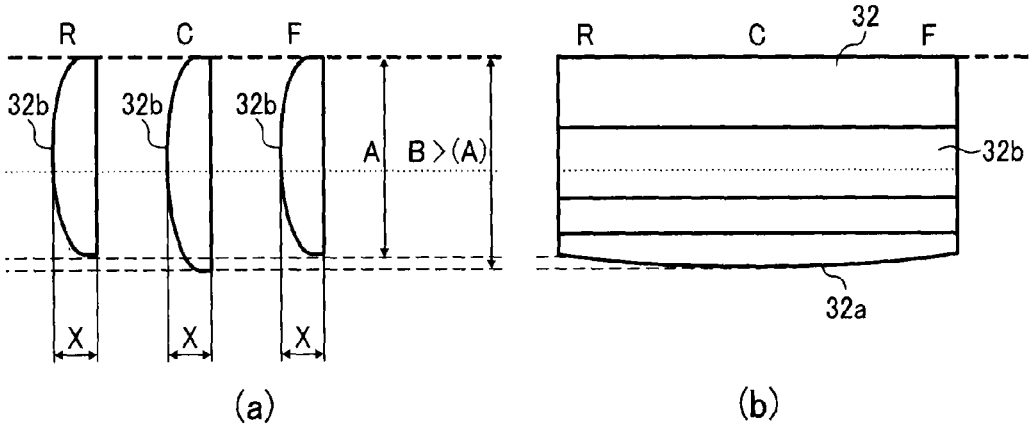
FIG. 8 is a sectional view of a separation pad incorporated in the fixing device shown in FIG. 2.

For example, the separation pad 32 depicted in FIG. 2 is made of metal such as SUS stainless steel and a rigid body such as resin. The separation pad 32 is a partially curved block or a partially arcuate block in cross-section. FIG. 8 is a sectional view of the separation pad 32. As shown in a diagram (b) of FIG. 8, the separation pad 32 includes a projection 32*a* at one end of the separation pad 32 in a short direction thereof. For example, the separation pad 32 has a length A in the short direction thereof at both lateral ends, that is, a front end F and a rear end R, of the separation pad 32 in a longitudinal direction thereof and a length B in the short direction thereof at a center C of the separation pad 32 in the longitudinal direction thereof. The length B is greater than the length A. As shown in a diagram (a) of FIG. 8, the separation pad 32 includes a planar portion 32*b* having a maximum thickness X in a thickness direction of the separation pad 32 throughout the entire span of the separation pad 32 in the longitudinal direction thereof. The diagram (a) of FIG. 8 illustrates a cross-section of the planar portion 32*b* at the front end F, the center C, and the rear end R of the separation pad 32.

Figure 9:
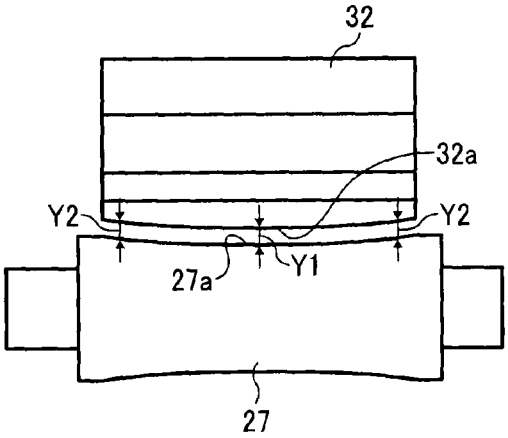
FIG. 9 is a plan view of the separation pad shown in FIG. 8 and the pressure roller shown in FIG. 7.

As shown in FIG. 2, the separation pad 32 is disposed opposite an inner circumferential surface of the fixing belt 26 at a position in proximity to and downstream from the fixing nip N in the sheet conveyance direction D8, thus contacting and supporting the fixing belt 26. FIG. 9 is a plan view of the separation pad 32 and the pressure roller 27. As shown in FIG. 9, the separation pad 32 is disposed opposite the pressure roller 27 via the fixing belt 26 depicted in FIG. 2 with a predetermined interval between the separation pad 32 and the pressure roller 27. For example, an interval Y2 between the separation pad 32 and the pressure roller 27 at each lateral end, that is, the front end F and the rear end R, of the separation pad 32 in the longitudinal direction thereof parallel to the axial direction of the pressure roller 27 is identical to or equivalent to an interval Y1 between the separation pad 32 and the pressure roller 27 at the center C of the separation pad 32 in the longitudinal direction thereof.

Alternatively, the interval Y2 may not be identical to or equivalent to the interval Y1 throughout the entire span of the separation pad 32 in the longitudinal direction thereof. For example, the interval Y1 may be greater or smaller than the interval Y2 if a curvature of the pressure roller 27 achieves separation of the sheet 8 from the fixing belt 26. Yet alternatively, a slide sheet may be interposed between the separation pad 32 and the inner circumferential surface of the fixing belt 26. The slide sheet prevents damage to the fixing belt 26.

A description is provided of a configuration of the separation device 50 and the separation pad 32.

Figure 10:
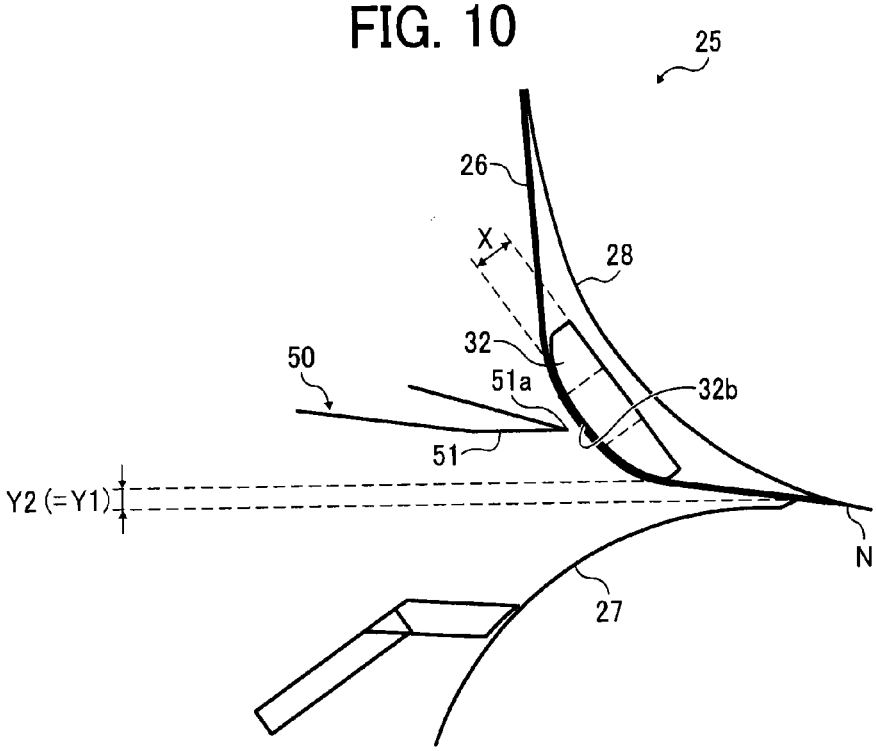
FIG. 10 is a partial vertical sectional view of the fixing device shown in FIG. 2 illustrating a separation device and the separation pad incorporated therein.

FIG. 10 is a partial vertical sectional view of the fixing device 25 illustrating the separation device 50 and the separation pad 32. As shown in FIG. 10, the separation device 50 disposed downstream from the fixing nip N in the sheet conveyance direction D8 includes a separation plate 51 having a front edge 51*a* directed to the planar portion 32*b* having the maximum thickness X of the separation pad 32. Accordingly, the separation plate 51 facilitates adjustment of an interval between the separation plate 51 and the separation pad 32 via the fixing belt 26.

Figure 11:
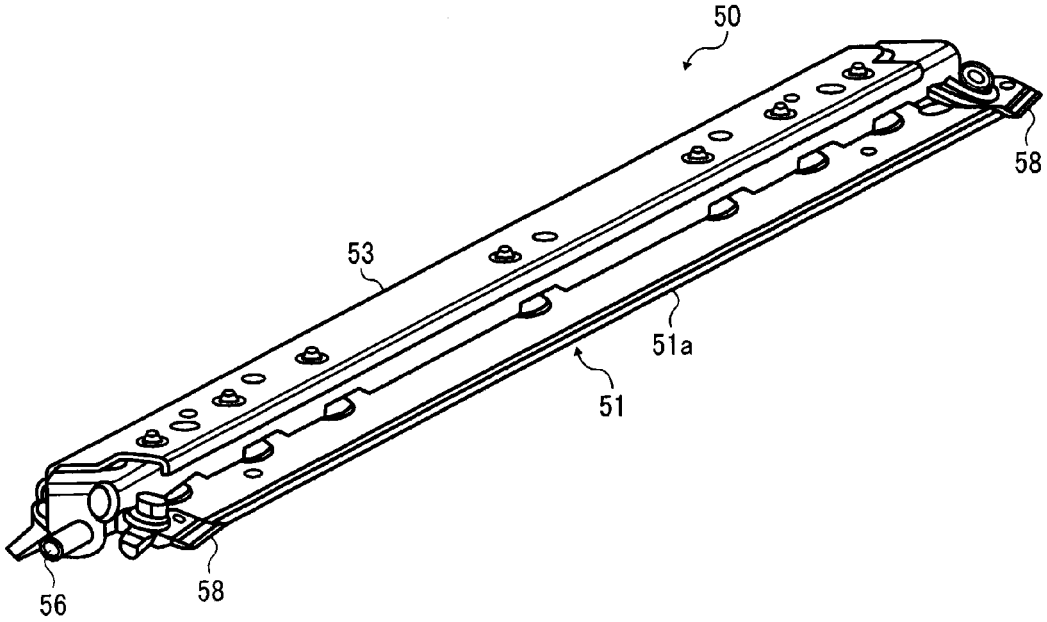
FIG. 11 is a perspective view of the separation device shown in FIG. 10.

FIG. 11 is a perspective view of the separation device 50. As shown in FIG. 11, the separation device 50 serving as a second separator includes the separation plate 51 serving as a separation member; a stay 53 holding or mounting the separation plate 51; an interval adjuster 60 shown below in FIG. 13 that adjusts the interval, that is, a gap, between the separation plate 51 and the separation pad 32 via the fixing belt 26; an abutment plate 58 serving as an abutment; and a pin 56. The pin 56 engages a hole or a through-hole of the fixing device 25 to mount the separation device 50 inside the fixing device 25.

The abutment plate 58 is disposed opposite an outboard span of the stay 53 situated at each lateral end of the stay 53 in a longitudinal direction thereof parallel to the axial direction of the pressure roller 27 that is outboard from a maximum image span on the fixing belt 26 in an axial direction thereof where the toner image on the sheet 8 is conveyed over the fixing belt 26 or a conveyance span on the pressure roller 27 in the axial direction thereof where the sheet 8 is conveyed over the pressure roller 27. As a front edge of the abutment plate 58 contacts and slides over the fixing belt 26, the abutment plate 58 positions the separation plate 51 relative to the fixing belt 26. The abutment plate 58 projecting from the front edge 51*a* of the separation plate 51 toward the fixing belt 26 isolates the front edge 51*a* of the separation plate 51 from the fixing belt 26 constantly. According to this exemplary embodiment, the abutment plate 58 contacts the fixing belt 26. Alternatively, the abutment plate 58 may contact the pressure roller 27.

Figure 12:
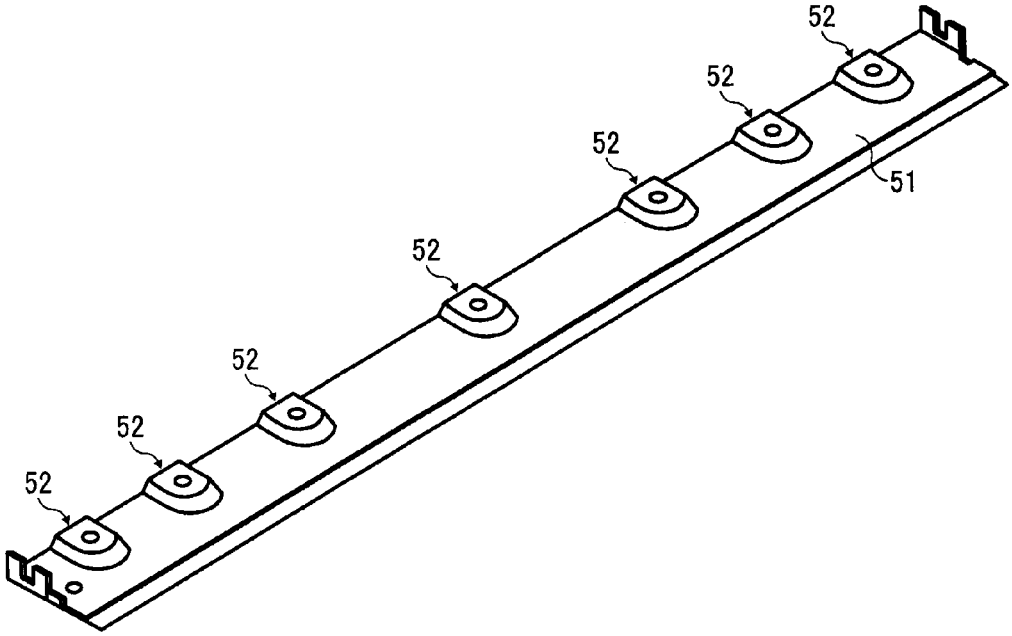
FIG. 12 is a perspective view of a separation plate incorporated in the separation device shown in FIG. 11.

FIG. 12 is a perspective view of the separation plate 51. As shown in FIG. 12, the separation plate 51 is a single plate having an axial span greater than the maximum image span in the axial direction of the fixing belt 26. The separation plate 51 mounts a plurality of protrusions 52 or embosses, for example, the seven U-shaped protrusions 52 according to this exemplary embodiment, at a downstream part of the separation plate 51 in the sheet conveyance direction D8. Alternatively, the protrusion 52 may have shapes other than the U-shape. Further, the number of the protrusions 52 mounted on the separation plate 51 is not limited to seven. The protrusion 52 has a seat surface great enough to allow a spring 55 and a screw 54 described below to attain their advantages.

Figure 13:
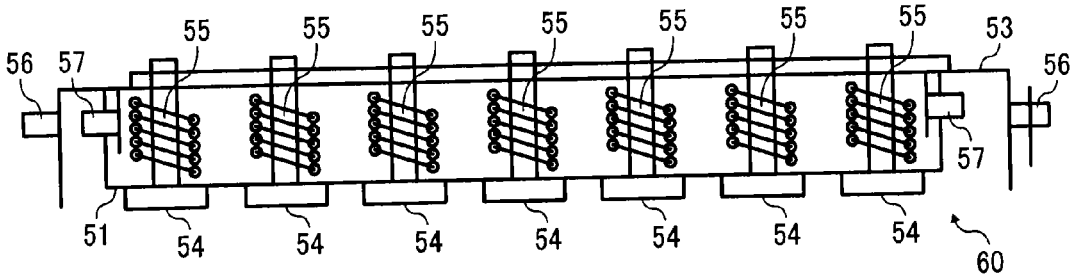
FIG. 13 is a plan view of an interval adjuster incorporated in the separation device shown in FIG. 11.

FIG. 13 is a plan view of the interval adjuster 60. As shown in FIG. 13, the interval adjuster 60 includes the screw 54 serving as a fastener that fastens the separation plate 51 to the stay 53 and the spring 55 serving as a biasing member interposed between the stay 53 and the screw 54 to exert a bias therebetween. The interval adjuster 60 is disposed at each protrusion 52 depicted in FIG. 12. The interval adjuster 60 moves the separation plate 51 attached to the stay 53 with a slide pin 57 vertically in FIG. 13. However, the separation plate 51 does not move in the sheet conveyance direction D8. As the screw 54 is turned about a screw axis clockwise, the screw 54 is screwed to adjust the interval between the front edge 51*a* of the separation plate 51 and the fixing belt 26. According to this exemplary embodiment, the interval adjuster 60 moves the separation plate 51 vertically in FIG. 13. Alternatively, the interval adjuster 60 may move the separation plate 51 in other directions.

Since the plurality of interval adjusters 60 is aligned in the axial direction of the fixing belt 26, the interval adjusters 60 perform fine adjustment of the interval between the fixing belt 26 and the separation plate 51. Accordingly, even if thin paper is used as a sheet 8, the separation plate 51 separates the thin paper from the fixing belt 26 effectively.

A front end of the separation plate 51 has a decreased thickness of about 0.2 mm plus and minus about 0.1 mm. Accordingly, the front end of the separation plate 51 is disposed in proximity to a downstream end of the fixing nip N in the sheet conveyance direction D8. Consequently, the separation plate 51 peels the sheet 8 ejected from an exit of the fixing nip N off the fixing belt 26 quickly. As a result, the toner image on the sheet 8 does not overheat.

Optionally, the front edge 51*a* of the separation plate 51 is adhered with tape made of fluoroplastic, for example, tape made of Teflon®. In this case, a front end of the separation device 50 has a thickness, that is, a combined thickness of the separation plate 51 and the tape, not greater than about 0.5 mm. The front end of the separation plate 51, even if the tape that facilitates separation of the sheet 8 is wound around the front end of the separation plate 51, is situated closer to the exit of the fixing nip N. Accordingly, the separation plate 51 improves its separation property of peeling the sheet 8 ejected from the exit of the fixing nip N off the fixing belt 26 more effectively and quickly. As a result, the toner image on the sheet 8 does not overheat.

A description is provided of advantages of the image forming apparatus 1 incorporating the fixing device 25.

As shown in FIGS. 8 and 9, since the projection 32*a* of the separation pad 32 is isolated from the recessed pressure roller 27, the separation pad 32 improves its separation property of separating the sheet 8 ejected from the exit of the fixing nip N from the fixing belt 26 at any position on the pressure roller 27 in the axial direction thereof. Additionally, the separation pad 32 prevents the sheet 8 from being wound around the fixing belt 26 and being jammed.

As shown in FIG. 10, the front edge 51*a* of the separation plate 51 is disposed opposite the planar portion 32*b* of the separation pad 32, retaining a predetermined interval between the front edge 51*a* of the separation plate 51 and the fixing belt 26. Hence, the separation plate 51 does not damage the fixing belt 26 and the fixing roller 28.

As shown in FIG. 13, the plurality of interval adjusters 60 achieves fine adjustment of the interval between the separation plate 51 and the fixing belt 26. Accordingly, even if the interval between the separation plate 51 and the fixing belt 26 is even throughout the entire span of the fixing belt 26 or the pressure roller 27 in the axial direction thereof, the separation plate 51 is planar, not warped. Consequently, when the sheet 8 strikes the separation plate 51, the separation plate 51 exerts an even force to the sheet 8, suppressing local damage to the toner image on the sheet 8.

With reference to FIGS. 14 to 18, a description is provided of a construction of a separation pad 132 as a variation of the separation pad 32 shown in FIG. 8.

The separation pad 132 is installable in the fixing device 25 incorporated in the image forming apparatus 1. It is to be noted that identical reference numerals are assigned to components shown in FIGS. 14 to 18 that are identical to the components shown in FIGS. 8 to 13 and a description of the identical components is omitted. The separation pad 132, serving as a first separator, a separation assist member, or a separation support member, is different from the separation pad 32 in construction.

Figure 14:
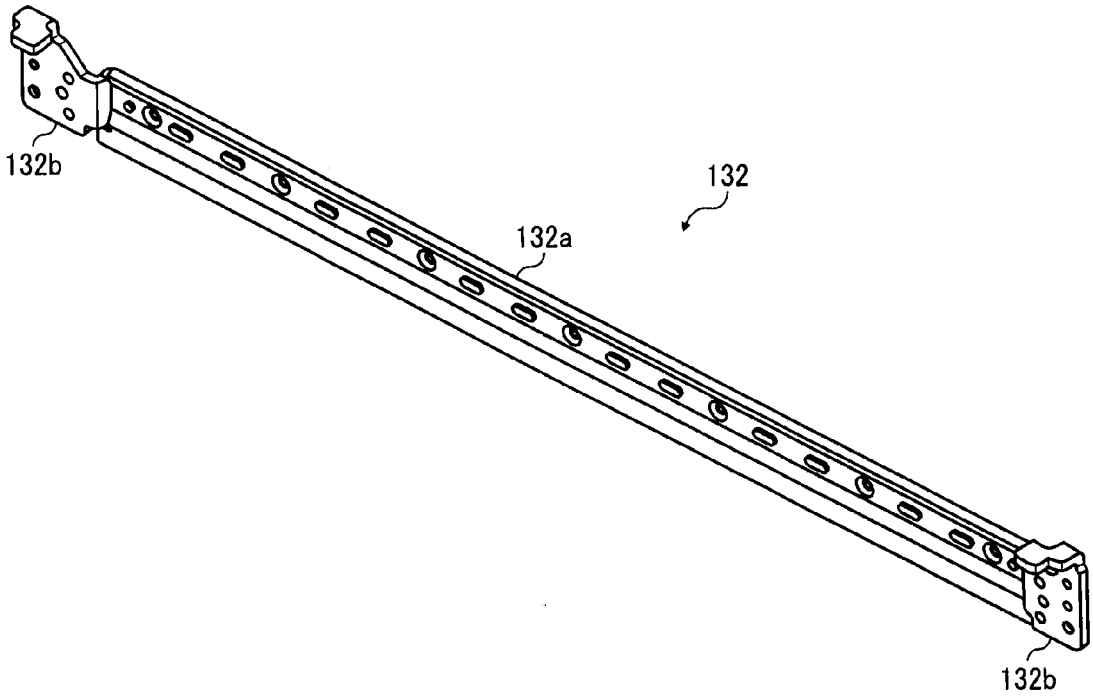
FIG. 14 is a perspective view of a separation pad as a variation of the separation pad shown in FIG. 8.

FIG. 14 is a perspective view of the separation pad 132. As shown in FIG. 14, the separation pad 132 made of a steel plate, for example, includes an elongate portion 132*a* and a stepped portion 132*b*. The elongate portion 132*a* serving as a bulge extends in a longitudinal direction of the separation pad 132 parallel to the axial direction of the fixing belt 26 and the pressure roller 27. The stepped portion 132*b* is a bent step disposed at each lateral end of the elongate portion 132*a* in the longitudinal direction of the separation pad 132 to contact and halt the fixing belt 26, preventing the fixing belt 26 from being skewed in the axial direction thereof.

Figure 15:
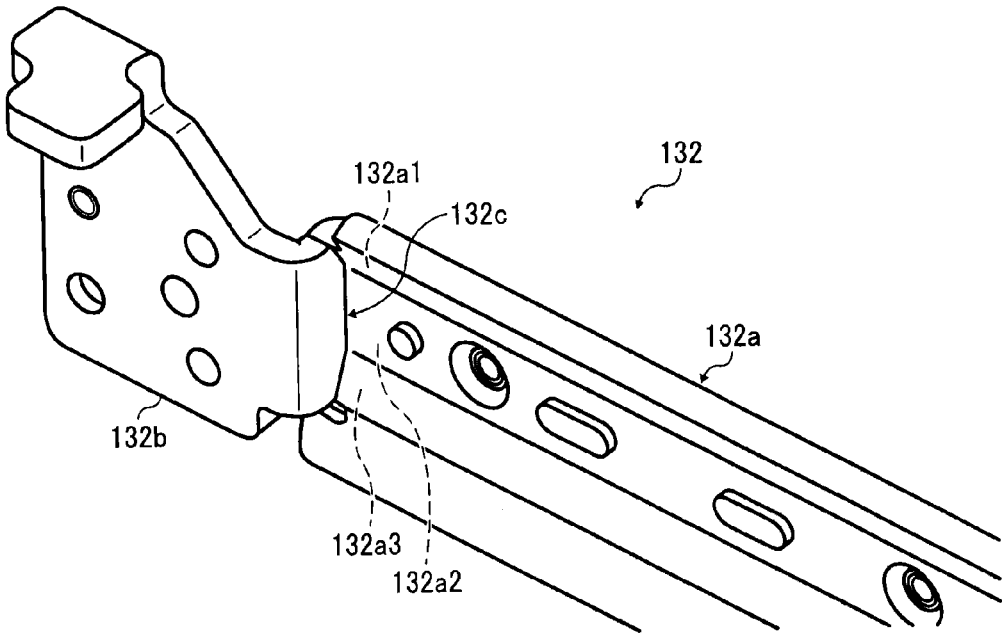
FIG. 15 is a partial perspective view of the separation pad shown in FIG. 14.

FIG. 15 is a partial perspective view of the separation pad 132. As shown in FIG. 15, the elongate portion 132*a* is formed in a bulge constructed of three planes 132*a*1, 132*a*2, and 132*a*3 extending in the longitudinal direction of the separation pad 132 and angled differently from each other. The front edge 51*a* of the separation plate 51 of the separation device 50 is directed to one of the three planes 132*a*1, 132*a*2, and 132*a*3 of the elongate portion 132*a*. Alternatively, instead of the three planes 132*a*1, 132*a*2, and 132*a*3, the elongate portion 132*a* may be constructed of four or more planes.

The stepped portion 132*b* includes a juncture 132*c* abutting the three planes 132*a*1, 132*a*2, and 132*a*3 of the elongate portion 132*a* to enhance the rigidity of the elongate portion 132*a*.

Figure 16:
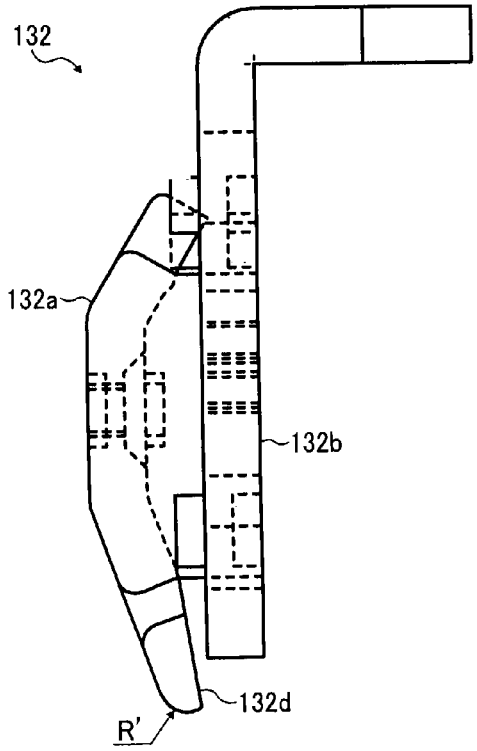
FIG. 16 is a sectional view of the separation pad shown in FIG. 14.

FIG. 16 is a sectional view of the separation pad 132. As shown in FIG. 16, the elongate portion 132*a* includes a front end 132*d* having a plate thickness that decreases gradually toward a front edge of the elongate portion 132*a*. A front edge of the front end 132*d* is rounded into an arch R' having a radius in a range of from about 1 mm to about 3 mm. Like the projection 32*a* of the separation pad 32 depicted in FIGS. 8 and 9, the front end 132*d* of the separation pad 132 is curved in the longitudinal direction of the separation pad 132 into a projection. Thus, the front end 132*d* of the separation pad 132 is disposed opposite the recess 27*a* of the pressure roller 27 via the fixing belt 26 with a predetermined interval between the separation pad 132 and the pressure roller 27. If the pressure roller 27 disposed opposite the separation pad 132 is curved into a hand drum shape or an inverted crown shape to produce the recess 27*a*, the front end 132*d* of the separation pad 132 is contoured as described above. Alternatively, the arch R' may have a radius other than the radius in the range of from about 1 mm to about 3 mm.

The separation pad 132 is produced by molding a cold rolled steel plate by pressing. A surface of the separation pad 132 may be treated with plating to prevent rust. Alternatively, the separation pad 132 may be produced by molding a stainless steel plate instead of the cold rolled steel plate. If the stainless steel plate is used, plating may be omitted. Further, the separation pad 132 may be manufactured by methods other than pressing.

Figure 17:
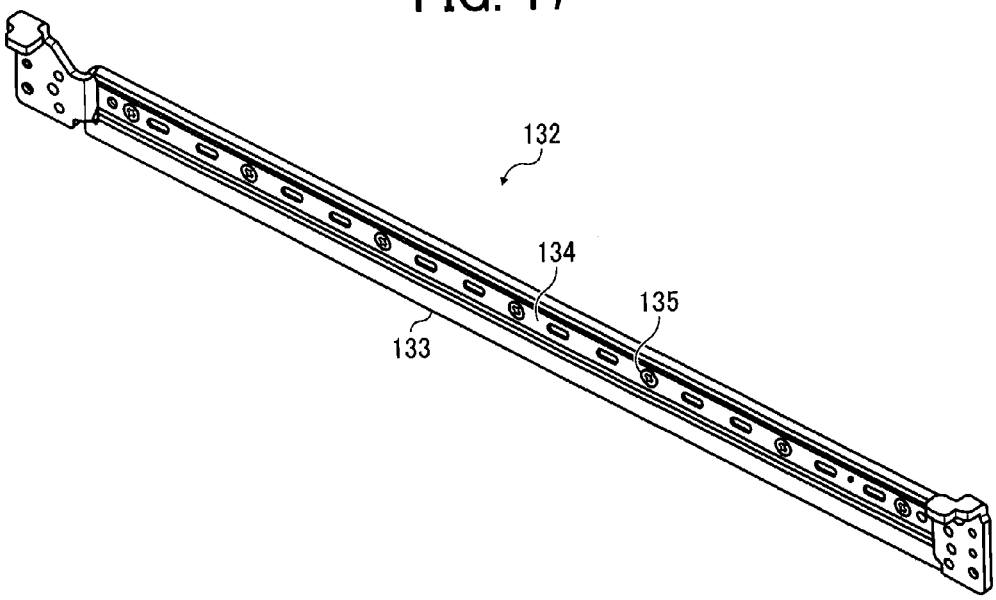
FIG. 17 is a perspective view of the separation pad shown in FIG. 14 illustrating a slide sheet incorporated therein.
Figure 18:
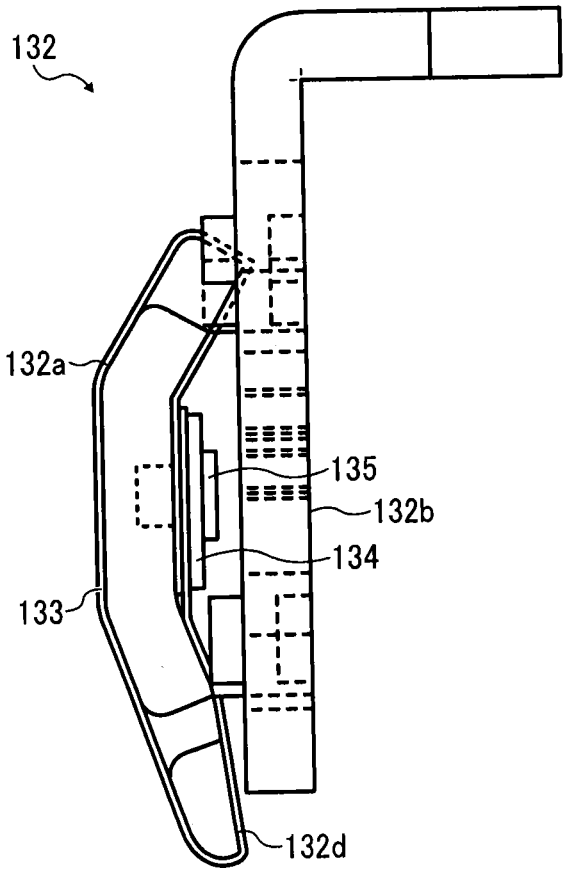
FIG. 18 is a sectional view of the separation pad shown in FIG. 16 illustrating the slide sheet incorporated therein.

FIG. 17 is a perspective view of the separation pad 132. FIG. 18 is a sectional view of the separation pad 132. As shown in FIGS. 17 and 18, the separation pad 132 may include a slide sheet 133 that facilitates sliding of the inner circumferential surface of the fixing belt 26 over the separation pad 132. As shown in FIG. 18, the slide sheet 133 covers a slide face of the elongate portion 132*a* of the separation pad 132 over which the fixing belt 26 slides throughout the entire span of the elongate portion 132*a* in a longitudinal direction thereof parallel to the axial direction of the fixing belt 26. The slide sheet 133 is double-layered at a part on an opposite face of the elongate portion 132*a*, that is, a back face, opposite the slide face of the elongate portion 132*a*. A sheet metal 134 presses the double-layered part of the slide sheet 133 against the elongate portion 132*a*. A screw 135 fastens the sheet metal 134 and the slide sheet 133 to the elongate portion 132*a*. Instead of mounting the slide sheet 133, the surface of the separation pad 132 may be treated with fluorine coating to attain the advantage described above.

The material and dimension of each of the components described above are examples and therefore various materials and dimensions thereof may be selectively used.

A description is provided of advantages of the fixing device 25.

As shown in FIG. 2, the fixing device 25 includes a fixing rotator (e.g., the fixing roller 28) rotatable in a predetermined direction of rotation (e.g., the rotation direction D28); a support rotator (e.g., the heating roller 31); a fixing belt (e.g., the fixing belt 26) stretched taut across the fixing rotator and the support rotator; and a pressure rotator (e.g., the pressure roller 27) pressed against the fixing rotator via the fixing belt to form the fixing nip N between the fixing belt and the pressure rotator. As a recording medium (e.g., a sheet 8) bearing a toner image is conveyed through the fixing nip N, the fixing belt and the pressure rotator fix the toner image on the recording medium. The fixing device 25 further includes a first separator (e.g., the separation pads 32 and 132) disposed downstream from the fixing nip N in a recording medium conveyance direction and contacting an inner circumferential surface of the fixing belt. As shown in FIG. 7, the pressure rotator includes the recess 27*a* that defines an outer diameter of each lateral end of the pressure rotator in an axial direction thereof that is greater than an outer diameter of a center of the pressure rotator in the axial direction thereof. As shown in FIGS. 8 and 16, the first separator includes a projection (e.g., the projection 32*a* and the front end 132*d*) disposed opposite the recess 27*a* of the pressure rotator. The first separator is isolated from the pressure rotator.

Accordingly, the first separator enhances its separation property of separating the recording medium from the fixing belt with a simple construction of the fixing device 25.

According to the exemplary embodiments described above, the fixing belt 26 serves as a fixing belt. Alternatively, a fixing film, a fixing sleeve, or the like may be used as a fixing belt. Further, the pressure roller 27 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator;

a support rotator disposed opposite the fixing rotator;

a fixing belt stretched taut across the fixing rotator and the support rotator;

a pressure rotator pressed against the fixing rotator via the fixing belt to form a fixing nip between the fixing belt and the pressure rotator, through which a recording medium bearing a toner image is conveyed, the pressure rotator including a recess defining an outer diameter of each lateral end of the pressure rotator in an axial direction thereof that is greater than an outer diameter of a center of the pressure rotator in the axial direction thereof; and a first separator disposed downstream from the fixing nip in a recording medium conveyance direction and contacting an inner circumferential surface of the fixing belt, the first separator being isolated from the pressure rotator so that the first separator does not form any fixing nip between the fixing belt and the pressure rotator, and the first separator including a projection disposed opposite the recess of the pressure rotator.

2. The fixing device according to claim 1, wherein the projection of the first separator corresponds to the recess of the pressure rotator.

3. The fixing device according to claim 1, further comprising a second separator including a front edge disposed opposite the first separator via the fixing belt without contacting the fixing belt, wherein the first separator further includes a planar portion disposed opposite the front edge of the second separator.

4. The fixing device according to claim 3, wherein the second separator further includes an abutment contacting each lateral end of the fixing belt in an axial direction thereof that is outboard from a conveyance span on the fixing belt in the axial direction thereof where the recording medium is conveyed.

5. The fixing device according to claim 4, wherein the second separator further includes at least one interval adjuster aligned in the axial direction of the fixing belt to adjust an interval between the fixing belt and the front edge of the second separator.

6. The fixing device according to claim 5, wherein the second separator further includes a separation plate mounting the front edge of the second separator and the abutment, and wherein the abutment projects from the separation plate toward the fixing belt.

7. The fixing device according to claim 6, wherein the second separator further includes a stay mounting the separation plate.

8. The fixing device according to claim 7, wherein the interval adjuster includes:

a screw to fasten the separation plate to the stay to adjust the interval between the fixing belt and the front edge of the second separator; and a spring interposed between the stay and the screw to exert a bias therebetween.

9. The fixing device according to claim 8, wherein the second separator further includes at least one protrusion mounted on the separation plate, and wherein the interval adjuster is disposed at the protrusion.

10. The fixing device according to claim 3, wherein the first separator further includes a bulge constructed of three planes extending in a longitudinal direction of the first separator and angled differently from each other, and wherein one of the three planes includes the planar portion disposed opposite the front edge of the second separator.

11. The fixing device according to claim 10, wherein the first separator further includes a stepped portion disposed at each lateral end of the bulge in the longitudinal direction of the first separator to contact and halt the fixing belt skewed in an axial direction thereof.

12. The fixing device according to claim 10, wherein the first separator further includes a juncture abutting the three planes of the bulge.

13. The fixing device according to claim 10, wherein the first separator further includes a slide sheet interposed between the bulge and the fixing belt.

14. The fixing device according to claim 1, wherein the projection of the first separator is curved in a longitudinal direction of the first separator.

15. The fixing device according to claim 1, wherein the first separator includes a separation pad.

16. The fixing device according to claim 1, wherein each of the fixing rotator, the support rotator, and the pressure rotator includes a roller.

17. An image forming apparatus comprising:

an image forming device to form a toner image; and a fixing device, disposed downstream from the image forming device in a recording medium conveyance direction, to fix the toner image on a recording medium, the fixing device including:

a fixing rotator;

a support rotator disposed opposite the fixing rotator;

a fixing belt stretched taut across the fixing rotator and the support rotator;

a pressure rotator pressed against the fixing rotator via the fixing belt to form a fixing nip between the fixing belt and the pressure rotator, through which the recording medium bearing the toner image is conveyed, the pressure rotator including a recess defining an outer diameter of each lateral end of the pressure rotator in an axial direction thereof that is greater than an outer diameter of a center of the pressure rotator in the axial direction thereof; and a first separator disposed downstream from the fixing nip in the recording medium conveyance direction and contacting an inner circumferential surface of the fixing belt, the first separator being isolated from the pressure rotator so that the first separator does not form any fixing nip between the fixing belt and the pressure rotator, and the first separator including a projection disposed opposite the recess of the pressure rotator.

18. A fixing device comprising:

a fixing rotator;

a support rotator disposed opposite the fixing rotator;

a fixing belt stretched taut across the fixing rotator and the support rotator;

a pressure rotator pressed against the fixing rotator via the fixing belt to form a fixing nip between the fixing belt and the pressure rotator, through which a recording medium bearing a toner image is conveyed, the pressure rotator including a recess defining an outer diameter of each lateral end of the pressure rotator in an axial direction thereof that is greater than an outer diameter of a center of the pressure rotator in the axial direction thereof;

a first separator disposed downstream from the fixing nip in a recording medium conveyance direction and contacting an inner circumferential surface of the fixing belt, the first separator being isolated from the pressure rotator and including a projection disposed opposite the recess of the pressure rotator; and a second separator including a front edge disposed opposite the first separator via the fixing belt without contacting the fixing belt, wherein the first separator further includes a planar portion disposed opposite the front edge of the second separator wherein the first separator further includes a bulge constructed of three planes extending in a longitudinal direction of the first separator and angled differently from each other, and wherein one of the three planes includes the planar portion disposed opposite the front edge of the second separator.

* * * * *